United States Patent [19]

Waine et al.

[11] Patent Number: 4,499,937

[45] Date of Patent: Feb. 19, 1985

[54] WINDOW SHADE SYSTEM FOR REDUCING HEAT TRANSPORT THROUGH WINDOWS

[75] Inventors: Martin Waine, Riverside; Edward T. Rude, Fairfield; Jules Nisenson, Stamford, all of Conn.

[73] Assignee: General Clutch Corp., New York, N.Y.

[21] Appl. No.: 341,302

[22] Filed: Jan. 21, 1982

[51] Int. Cl.[3] ..... E06B 7/16

[52] U.S. Cl. ..... 160/41; 160/271

[58] Field of Search ..... 160/23 R, 41, 267-273, 160/290, 384, 387, 388

[56] References Cited

U.S. PATENT DOCUMENTS

| | | | |
|---|---|---|---|
| 1,184,208 | 5/1916 | Peter | 160/23 R |
| 2,351,373 | 6/1944 | Thexton | 160/387 |
| 2,354,489 | 7/1944 | Tucker | 160/41 |

*Primary Examiner*—Peter M. Caun

*Attorney, Agent, or Firm*—Gottlieb, Rackman & Reisman

[57] ABSTRACT

There is disclosed a window shade system which reduces heat transport through windows by providing an insulating seal between a shade and window sill. The insulating seal is effected by a resilient material attached to the bottom longitudinal edge section of the shade. When the bottom longitudinal edge section of the shade is positioned in engagement with the sill, the resilient material conforms to the contour of the sill, frictionally sealing the shade against the sill, thereby insulating and reducing heat transport through the window. In a preferred embodiment of the invention, the bottom longitudinal edge section includes a first depending longitudinal slat pocket for receiving a window shade slat, and a second depending longitudinal pocket configured to substantially enclose the slat pocket. A longitudinal void is provided between the pockets to permit the enclosing pocket to resiliently conform to the contour of the sill.

5 Claims, 10 Drawing Figures

WINDOW SHADE SYSTEM FOR REDUCING HEAT TRANSPORT THROUGH WINDOWS

BACKGROUND OF THE INVENTION

This invention relates to window shade systems, and more particularly to window shade systems useful for reducing heat transport through windows.

Windows are a conduit through which large amounts of heat are transported into and out of buildings. Buildings gain heat rapidly through windows when the outside air temperature is high, and in winter months when the outside temperature is low, windows constitute one of the largest heat leaks in both residential and commercial structures.

Expensive and complex systems exist to minimize these heat losses and gains. Often, however, such systems are not used because they are expensive, inconvenient to install and operate, and because such systems detract from the aesthetic appearance of the windows in which they are used.

Window shades are among the commonest and least expensive forms of window covering. For these reasons, and because of the ease with which window shades may be installed, they are often replaced to accommodate changing fashions and design modes. An improvement in the insulating quality of window shades can provide a quick and inexpensive reduction of heat flow problems in both residential and commercial buildings.

Conventional window shades permit heat transport through windows by the passage of air between the edges of the shade and window frame. An effective seal between the side edges of the shade and the frame is not provided because the shade must be spaced from the frame to permit upward and downward movement of the shade. Also, just bringing the window shade fully to the bottom of the window opening does not provide an entirely satisfactory insulating seal of the shade against the sill. This is because wooden window frames are often not square or even straight, or because the shade is not hung correctly, so that when the shade contacts the sill in one place, there may still be a gap in other places. Gaps between the shade and sill also result where, as is often the case, the bottom edge contacting surface of the shade has an irregular surface contour which prevents frictional and sealing engagement of the shade against the sill. Such irregularities are commonly caused by warpage of the wooden positioning slat which is affixed to the bottom edge section of the shade.

The prior art has recognized the need for improved energy efficient window shade systems and has provided teachings of systems which reduce the movement of air past the side edges of a shade. In this system, channels are installed along the vertical side walls of the window frame for receiving the side edge sections of the shade. The channels are provided with a generally U-shaped configuration to permit upward and downward movement of the shade, and to provide an insulating seal between the shade and side walls of the frame when the shade is positioned adjacent the sill. A similar channel with its open end facing upward from the window sill could be used for purposes of providing a seal between the sill and bottom longitudinal edge section of the shade. However, provision of a sill channel presents several disadvantages and they have not proved entirely satisfactory. It will be appreciated that such a channel becomes a catcher of dirt and small objects which are difficult to remove. Further, when the wooden positioning slat affixed to the bottom edge of the shade has an irregular curvature, it is difficult to position the bottom edge of the shade within the sill channel. Yet another disadvantage in using the channel at the sill is that the side wall and sill channels must be aligned and installed with precise tolerances in order to provide an insulating seal at the bottom corners of the window frame.

BRIEF SUMMARY OF THE INVENTION

Accordingly, it is the broad object of this invention to provide a window shade system which achieves a reduction in heat flow through a window by providing an improved insulating seal between the window frame and shade.

Another more specific object of the present invention is to provide a window shade system which prevents passage of air beneath the shade when it is positioned adjacent the window sill to enhance the insulating capacity of the shade.

Another object of this invention is to provide a window shade system including improved insulating features which are of uncomplicated design, which may be economically fabricated, and which may be installed without requirement of a skilled craftsman.

Yet another object of the invention is to provide a window shade system having improved manufacturing advantages by having fewer, less complex parts and by having lesser need for precision tolerances than prior art systems.

In the present invention, these purposes, as well as others which will be apparent, are achieved generally by provision of a window shade system which includes a shade having a top end section, side edge sections, and a bottom longitudinal edge section, configured to substantially overlie a window. An insulating seal between the shade and window sill is effected by a resilient material attached to the bottom longitudinal edge section of the shade. When the bottom edge section of the shade is positioned in engagement with the sill, the resilient material conforms to the contour of the sill, frictionally sealing the shade against the sill, thereby insulating and reducing heat transport through the window. The window shade system also includes U-shaped longitudinal channels which are affixed to the window frame side surfaces in opposing relation. The channels movably receive the side edge sections of the shade to reduce passage of air and consequent heat transport between the window frame and the shade.

In a preferred embodiment of the invention, the bottom longitudinal edge section includes a first depending longitudinal slat pocket configured to receive a window shade slat, and a depending second longitudinal pocket configured to substantially enclose the slat pocket. The enclosing pocket is fabricated of a flexible material and spaced from the slat pocket to define a longitudinal void between the slat and enclosing pockets. When the bottom longitudinal edge section of the shade is positioned in engagement with the sill, the enclosing pocket resiliently conforms to the contour of the sill to frictionally seal the shade against the sill.

In an alternative embodiment of the invention, an insulating seal between the window shade and frame is effected by replacing the enclosing pocket with a flexible flap of material. The flap depends from the slat pocket and resiliently conforms to the contour of the sill when the shade is positioned in engagement with the sill.

It should be recognized that the reduction in heat flow provided by the improved shade design of this invention may not be as large as that to be gained from other more elaborate and costly mechanisms. However, the fact that this improvement can be easily and relatively inexpensively implemented, and that shades are so often replaced, means that this improvement can have a rather large impact in energy conservation and fuel cost reduction.

Other objects, aspects, and advantages of the present invention will be apparent when the detailed description of the preferred embodiment of the invention is considered in conjunction with the drawings, which should be construed in an illustrative and not limiting sense, as follows:

DESCRIPTION OF THE PREFERRED EMBODIMENTS

Figure 1:
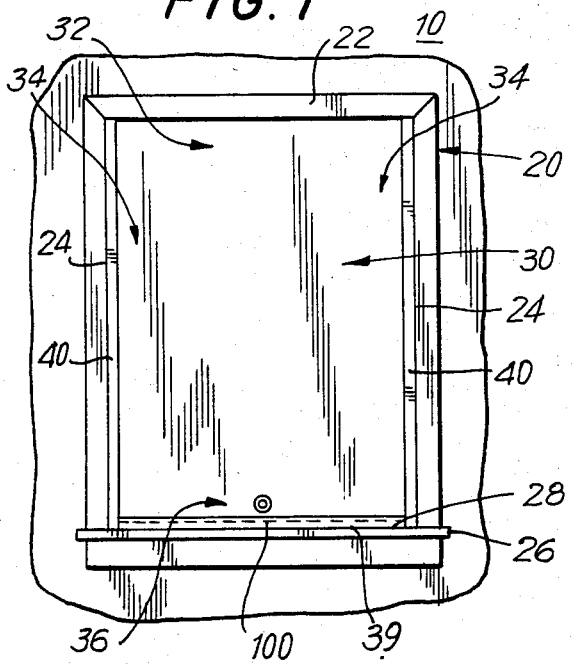
FIG. 1 is a front elevational view of a preferred embodiment of a window shade system in accordance with this invention installed within a window frame showing a shade sealingly positioned adjacent the frame.
Figure 6:
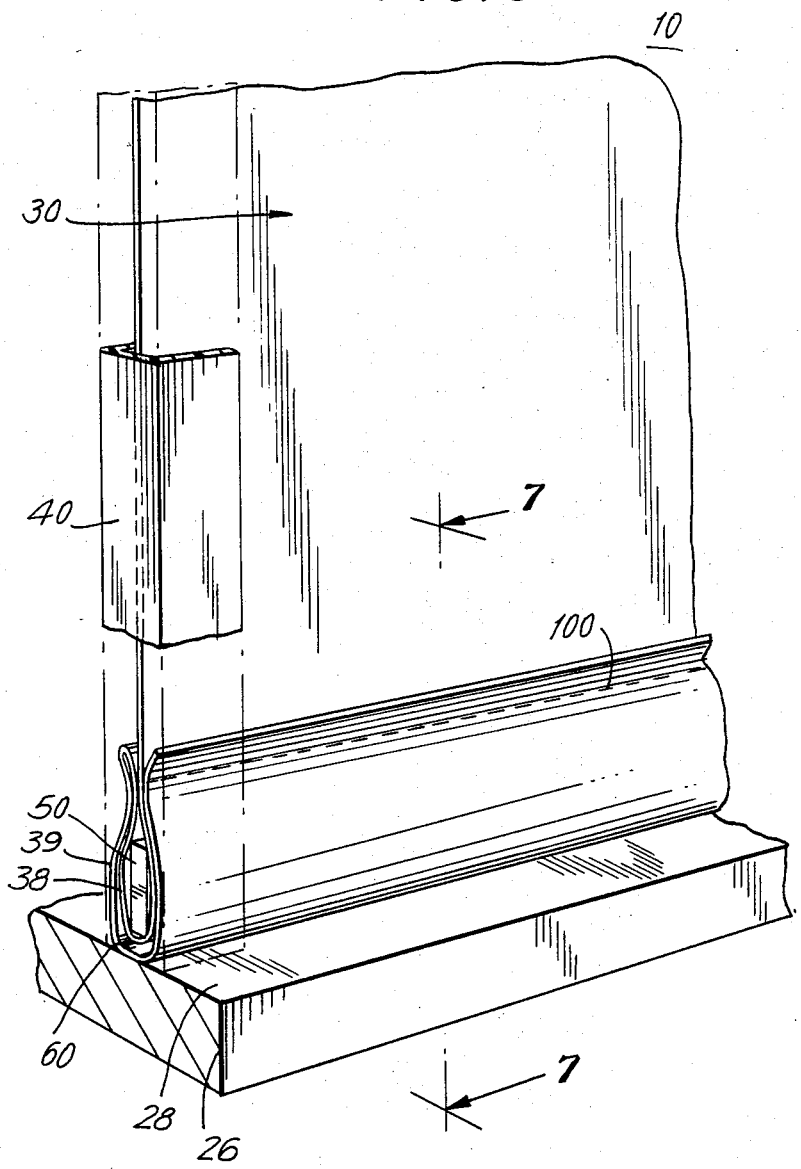
FIG. 6 is a fragmentary perspective view of the window shade of FIG. 1, illustrating the manner in which the shade is positioned within frame channels and in engagement with the window sill to insulate and reduce heat transport through the window.
Figure 7:
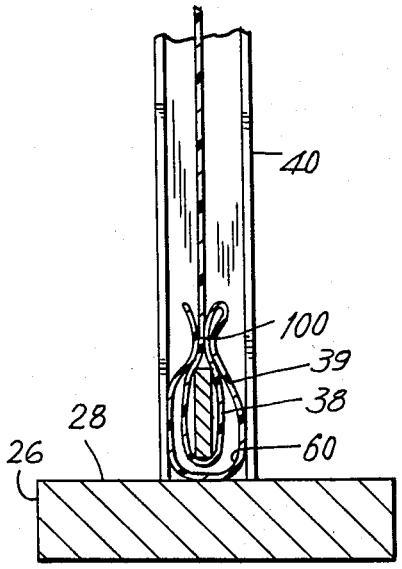
FIG. 7 is a transverse sectional view taken on line 7—7 of FIG. 6.

Referring now to the drawings, and more particularly FIGS. 1, 6 and 7 thereof, there is illustrated a window shade system in accordance with this invention generally designated 10 in association with a window housed within a frame 20. The window frame 20 includes a top end 22, generally planar side surfaces 24, and sill 26 having a top surface 28.

The window shade system 10 includes an improved shade 30 configured to substantially overlie the window, and vertically extending U-shaped channels 40. The shade 30 includes a top end section 32, side edge sections 34, and bottom longitudinal edge section 36. The channels 40 are affixed in opposing relation to the window frame side surfaces 24 for movably receiving the side edge sections of the shade 34 to prevent passage of air, and consequent heat transport, between the frame 20 and side edge sections of the shade 34.

Figure 2:
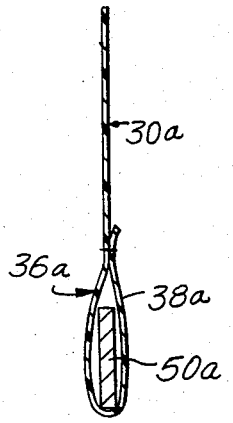
FIG. 2 PRIOR ART
FIG. 2 is a side elevational view of a conventional window shade including a longitudinal slat pocket and a slat positioned within the pocket.
Figure 3:
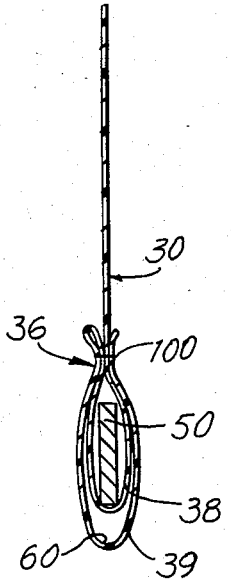
FIG. 3 is a side elevational view of the window shade of FIG. 1, illustrating the preferred shade configuration for providing an insulating seal at the window sill, wherein the bottom longitudinal edge section of the shade includes a first slat pocket and second enclosing pocket.
Figure 4A:
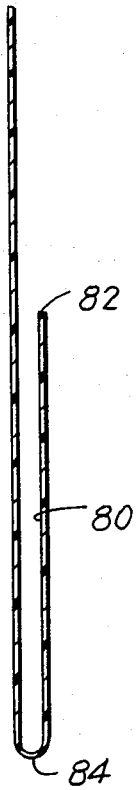
FIGS. 4(*a*)–4(*d*) the preferred method of folding the shade material to fabricate the pocket arrangement of FIG. 3.
Figure 4B:
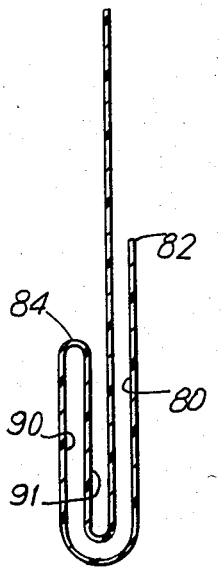
Figure 4C:
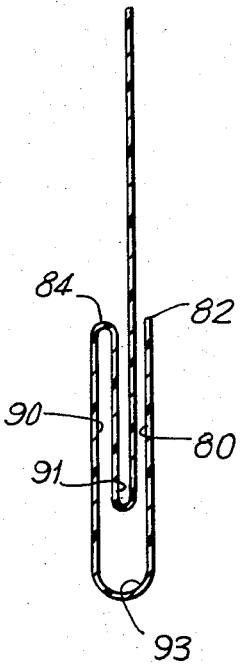
Figure 4D:
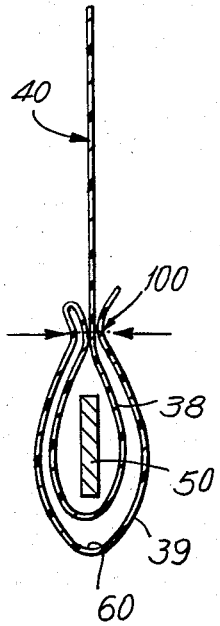

The shade 30 improves over the prior art shade construction shown in FIG. 2, by provision of an insulating means in bottom longitudinal edge section 36 for resiliently and sealingly engaging the top surface of the sill 28. A preferred construction of the invention is illustrated in FIGS. 3, 6 and 7, wherein the bottom longitudinal edge section includes a first depending longitudinal slat pocket 38, including a shade slat 50, and depending second longitudinal pocket 39 configured to substantially enclose slat pocket 38. The enclosing pocket 39 is fabricated of a flexible material, such as a vinyl film, and is spaced from the slat pocket 38 to define a longitudinal void 60 between the slat and the enclosing pockets 38, 39. When the bottom longitudinal edge section of the shade 36 is positioned in engagement with the top surface of the sill 28, as shown in FIG. 6, the enclosing pocket 38 resiliently conforms to the contour of the sill, frictionally sealing the shade 30 against the top surface of the sill 28, insulating and reducing heat transport through the window.

In order to provide an effective seal between the top surface of the sill 28 and the bottom longitudinal edge section 36 of the shade 30, the enclosing pocket 39 must resiliently conform to the contour of the top surface of the sill 28. Various constructions of the enclosing pocket 39 of this invention may be employed to provide the required resiliency. Features of the enclosing pocket 39 of the preferred embodiment of the invention include: (1) employment of a flexible material to fabricate the enclosing pocket; (2) provision of a longitudinal void 60 between the slat pocket 38 and the enclosing pocket 39; and (3) fabrication of the shade 30 and slat 50 of lightweight materials to facilitate positioning of the spaced pockets 38, 39 in conforming engagement with the top surface of the sill 28. It should be observed that these features coact to assure frictional and conforming engagement of the enclosing pocket 39 with the top surface of sill 28.

Figure 5:
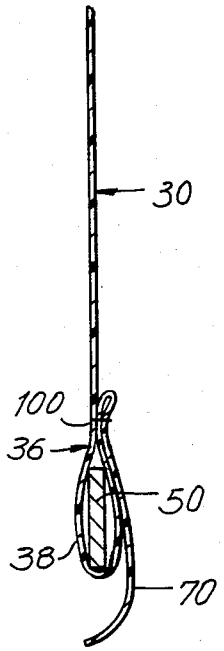
FIG. 5 is a side elevational view of an alternative shade configuration of this invention for providing an insulating seal at the window sill, wherein the bottom longitudinal edge section of the shade includes a depending flap of material.

An alternative insulating means in accordance with the present invention is illustrated in FIG. 5. In this embodiment, an insulating seal between the bottom longitudinal edge section of the shade 36 and the top surface of the sill 28 is effected by slat pocket 38 which includes slat 50 and a dependent flap of material 70. When the bottom longitudinal edge section of the shade 36 is positioned in engagement with the top surface of the sill 28, the flap 70 resiliently conforms to the contour of sill surface 28.

Referring to FIGS. 1 and 7, the channels 40 preferably extend the entire height of the window frame 20 from the top end of the frame 22 to the top surface of the sill 28. The channels 40 must also be of sufficient width to permit movement and positioning of the shade 30 in engagement with the top sill surface 28 (see FIG. 7). Where the restraining force provided by the channels 40 obstructs movement of the shade 30, as occurs where the channels 40 are narrow in width, a heavier slat 50 than normally used may be employed to insure free movement and sealing engagement of the shade 40 with sill surface 28. The weight of slat 50 may be similarly varied to accommodate shade materials of different weights and textures.

Method of Fabricating the Window Shade

The structural features of the window shade system have now been fully described, and it will be advantageous for a full understanding of the present invention, to discuss the method of fabricating the window shade.

In FIG. 2 there is illustrated a conventional shade 30*a* including a bottom longitudinal edge section 36*a* defining a slat pocket 38*a* configured to receive slat 50*a*. The slat pocket 38*a* is formed by folding a portion of the bottom edge section 36*a* of the shade 30*a* and then securing the fold to the shade 30*a*. The method for securing such folds in conventional shade materials are well known in the art. By way of example, cloth shades are typically fabricated by employing stitching techniques; plastic or vinyl shades are fabricated by employing heat welding methods. Those skilled in the art of window shade fabrication will appreciate that various methods may be employed to manufacture the window shade of FIG. 2. It will also be appreciated that these methods may similarly be employed to fabricate the window shade of the present invention.

A preferred method for fabricating the slat and enclosing pocket arrangement 38, 39 of the present invention is illustrated in FIGS. 4(*a*) through 4(*d*). Referring to FIGS. 4(*a*), the shade material is first folded to form a sleeve 80 having a lead end 82 and bottom end 84, the length of the fold being approximately one-half inch longer than twice the length required for fabrication of a conventional slat pocket 38. As shown in FIG. 4(*b*), the sleeve 80 is then folded onto itself to enclose a second sleeve 90. This second fold is sized so that there is a space 91 sufficient for fabrication of slat pocket 38. Referring again to FIG. 4(*b*), it can be seen that lead end 82 of sleeve 80 is positioned above and in opposing relation to bottom sleeve end 84. Next, as shown in FIG. 4(*c*), the lead end 82 of sleeve 80 is moved approximately one-half inch downwardly to a position directly opposite the bottom end of the sleeve 84 to define space 93 for fabrication of the enclosing pocket 39 in accordance with this invention.

Finally, as illustrated in FIG. 4(*d*), a longitudinally extending seam 100 extending across the width of the shade is provided to secure the sleeve sections together and form the slat and enclosing pocket arrangement 38, 39 of the invention. Where desired a hemmed edge may also be provided by employment of an additional length of material for fabrication of the pockets.

Advantageously, this procedure permits fabrication of the shade 30 from an integral length of material without requirement of further cuts in the material. The slat and enclosing pockets 38, 39 are also secured to the shade by employment of a single fastening seam 100.

The slat pocket 38 and flap 70 embodiment of the invention illustrated in FIG. 5 may also be fabricated by employing a folding procedure. A portion of the bottom longitudinal edge section of the shade 36 of sufficient length to form the slat pocket 38 and flap 70 is folded and secured to the shade by seam 100 as illustrated in FIG. 5. The end portion of the fold depends from the seam 100 to form flap 70.

It should be understood that the window shade system of this invention may be employed with conventional ratchet and pawl shade roller assemblies to facilitate movement of the shade 30 between the top end of the frame 22 and the top surface of the window sill 28. However, further advantage in positioning the shade is obtained by employment of a roller including the bidirectional clutch mechanism disclosed in U.S. patent application No. 244,975. The clutch mechanism permits accurate positioning of the shade 30 adjacent the window sill 26, assuring an insulating seal between the shade 30 and top surface of the sill 28.

It will be appreciated, therefore, that the present invention provides a window shade system 10 which overcomes the difficulties of prior art systems and which achieves the objects stated heretofore. In particular, the present invention provides a window shade system 10 which effects a reduction in heat flow through a window by provision of an improved insulating seal between the window frame 20 and window shade 30. More particularly, the system provides an insulating means including a resilient material affixed to the bottom longitudinal edge section 36 of the shade to reduce heat transport between the shade 30 and sill 26. The window shade system 10 also provides improved manufacturing advantages by having fewer less complex parts and lesser need for precision tolerances.

It should also be appreciated that various modifications are possible in light of the above disclosure. For example, the insulating seal between the shade 30 and the top surface of the sill 28 may include a band of soft foam. And although the shade 30, including bottom longitudinal edge section 36 insulating pockets 38, 39 and flap 70 arrangements are preferably formed by a folding procedure without cuts in the shade material, the bottom longitudinal edge section 36 may include separate material sections. The bottom longitudinal edge section 36 may also be fabricated of different component materials.

Accordingly, the above description is by way of example only, and modifications, changes and the like are contemplated within the scope of the invention which is set forth in the following claims.

What is claimed is:

1. A window shade system for a window housed within a frame including a top end, generally planar side surfaces, and a sill having a top surface, which comprises:

a shade configured to substantially overlie a window, said shade including a top end, side edge sections, and a bottom longitudinal edge section;

said bottom longitudinal edge section including a first depending longitudinal pocket, and a second longitudinal pocket configured to substantially enclose said first longitudinal pocket, said enclosing pocket being spaced from said first longitudinal pocket to define a longitudinal void between said pockets, so that when said shade is positioned adjacent the sill, said enclosing pocket conforms to the contour of the top surface of the window sill to frictionally seal the shade within the window frame, thereby preventing the passage of air beneath the window shade between the bottom longitudinal edge section of the shade and the sill enhancing the insulating capacity of the shade.

2. The window shade system of claim 1, further comprising a longitudinal slat, said slat being secured within said first longitudinal pocket.

3. The window shade system of claim 1, wherein said enclosing pocket is fabricated of a flexible material.

4. The window shade system of claim 1 wherein the shade is movable between a first position at the top end of the window frame and a second position at the sill of the window frame, further comprising a guide means affixed to the planar side surfaces of the window frame for receiving said shade side edge sections, said guide means providing an insulating seal between the planar side surfaces of the window frame and the side edge sections of the shade.

5. The window shade system of claim 4, wherein said guide means comprises vertically extending channels of a generally U-shaped configuration, said channels being affixed to the planar side surfaces of the window frame for receiving said shade side edge sections as said shade moves between the top end of the window frame and the sill.

* * * * *